United States Patent [19]

Powers et al.

[11] Patent Number: 4,637,295

[45] Date of Patent: Jan. 20, 1987

[54] PUMP SEAL WITH CURVED BACKUP PLATE

[76] Inventors: Frederick A. Powers, 10549 Lancaster La., Maple Grove, Minn. 55369; Thomas J. Gustafson, 8411 Toledo Ave. N., Brooklyn Park, Minn. 55433

[21] Appl. No.: 721,872

[22] Filed: Apr. 9, 1985

[51] Int. Cl.[4] ..... F01B 11/02; F04B 7/04; F02F 11/00

[52] U.S. Cl. ..... 92/170; 277/29; 277/152; 277/72 FM; 417/489

[58] Field of Search ..... 92/170, 171, 169, 168, 92/165 R, 167; 277/152, 29; 417/489

[56] References Cited

U.S. PATENT DOCUMENTS

| | | | |
|---|---|---|---|
| 1,925,729 | 9/1933 | Gits . | |
| 1,977,081 | 10/1934 | Olsen . | |
| 2,307,152 | 1/1943 | Murray . | |
| 2,598,271 | 5/1952 | Klosterman . | |
| 2,630,357 | 3/1953 | Smith | 309/33 |
| 2,867,462 | 1/1959 | Nielsen . | |
| 3,085,810 | 4/1963 | Howe, Jr. et al. . | |
| 3,275,331 | 9/1966 | Mastrobattista et al. . | |
| 3,291,495 | 12/1966 | Liebig | 277/152 |
| 3,310,230 | 3/1967 | Wirth . | |
| 3,421,604 | 1/1969 | Hobbs . | |
| 3,825,270 | 7/1974 | Paramonoff et al. . | |
| 3,912,284 | 10/1975 | Gosling et al. . | |
| 3,975,026 | 8/1976 | Boyle et al. . | |
| 4,013,386 | 3/1977 | Hardman et al. | 417/489 |
| 4,029,442 | 6/1977 | Schlooser | 417/489 |
| 4,035,109 | 7/1977 | Drath et al. . | |
| 4,042,248 | 8/1977 | Williamitis . | |
| 4,060,023 | 11/1977 | Vegella . | |
| 4,070,947 | 1/1978 | Crewse . | |
| 4,194,748 | 3/1980 | Forch et al. | 277/152 |
| 4,197,786 | 4/1980 | Pillon . | |
| 4,222,575 | 9/1980 | Sekiguchi et al. . | |
| 4,337,956 | 7/1982 | Hopper . | |

*Primary Examiner*—Larry Jones

[57] ABSTRACT

A pump seal is provided for use in a pump suited to move high viscosity and abrasive materials. A piston in the pump has a substantial amount of clearance relative to the cylinders in which it operates with the seal providing substantially the only contact in sealing between the piston and the cylinders. The seal is formed of a relatively soft, elastomeric material which is normally of a plainer, annular shape. Along with a rigid annular ring plate, the elastic ring is sandwiched between the closure member and housing member. The ring plate has a curved surface facing the closure member which serves to backup and support the relatively soft elastic ring under pressure.

5 Claims, 3 Drawing Figures

PUMP SEAL WITH CURVED BACKUP PLATE

BACKGROUND OF THE INVENTION

Pumps of the type shown in U.S. Pat. NO. 4,029,442 are well known for use in pumping abrasive and highly viscous materials. The contents of the said U.S. Pat. No. 4,029,442 are herein incorporated by reference. While the annular ring seal shown therein is highly effective in sealing against the piston and allowing that pump to perform, the piston and seal are subject to wear due to the highly abrasive materials which may be pumped. In particular, the seal typically used in commercial devices such as that referenced above, is generally made of a relatively hard nylon material. The wear mechanism in such seals results from abrasive particles becoming imbedded in the hard seal material, thus turning the seal into a composite of hard abrasive particles with a tough plastic which retains and supports those particles. It is primarily an object of this invention to provide an improved sealing mechanism which in particular extends the wear life of the piston and seal.

SUMMARY OF THE INVENTION

The instant invention is designed for pumps of the type shown in U.S. Pat. No. 4,029,442. The elastic ring is similar in shape to that shown in the aforementioned prior art patent, that being a normally flat, annular ring. The material out of which the ring is formed is a relatively soft, polyurethane, elastomer material. Were such a soft ring to be used intact in the prior art device with no other changes, the soft material would not be able to withstand the pressures generated in the pump and seal failure would occur. In order to provide proper support for the soft, elastic ring, the annular ring plate, which is sandwiched between the cylinder housing member and the closure member, is provided wherein the side of the rib facing the closure member has a conical surface buildup to urge the elastic ring into a conical configuration, even when not in contact with the piston.

These and other objects and advantages of my invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
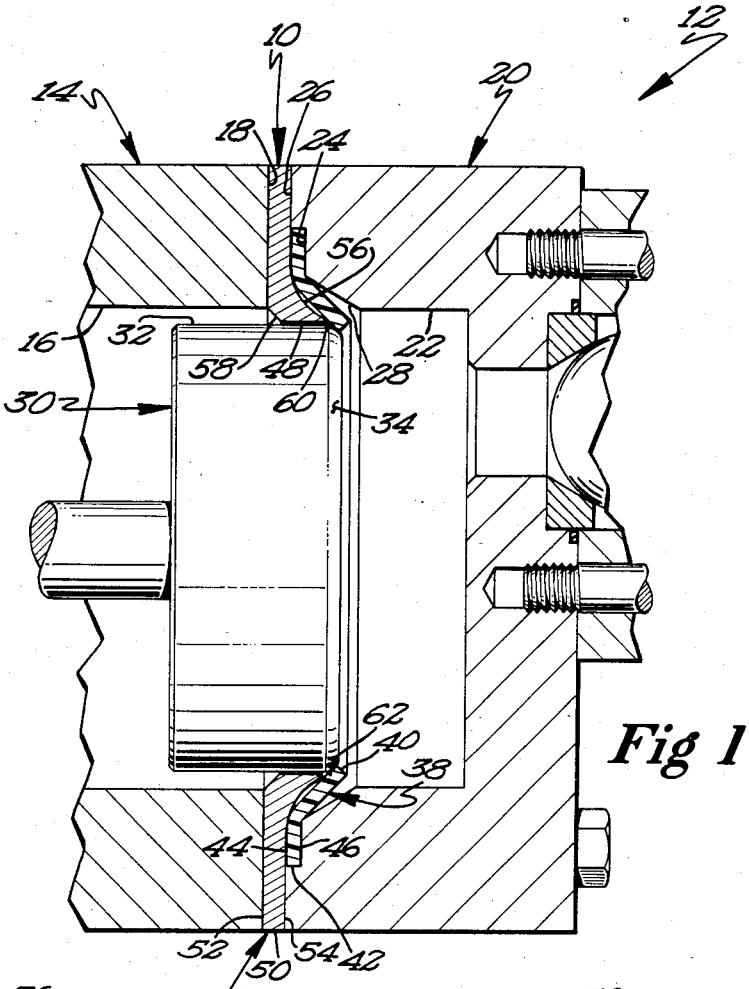
FIG. 1 is an elevational, partially sectional view showing a portion of a representative pump embodying the seal of the invention.

The pump seal 10 of the instant invention is shown in a portion of a pump 12 which is comprised of a cylinder member 14 having an inner bore 16 in and an end wall 18. Pump 12 is further comprised of a closure member 20 having an inner bore of 22, a counter bore 24 and an end wall 26. A portion of the seal 10 is located in counter bore 24 which is connected to inner bore 22 by a chamfered surface 28.

A piston 30 is slideably located in the bores 16 and 22 of cylinder member 14 and closure member 20. The various diametrical relationships of the various bores, pistons and seals are discussed more specifically in the above-referenced and incorporated U.S. Pat. No. 4,029,442, as well as more complete details of the pumping environment in which the seal 10 is utilized.

Seal 10 is comprised more specifically of a ring plate 36 and an elastic ring 38. Elastic ring 38 is generally a flat annular piece in shape and has an inner diameter 40, an outer diameter 42, a first face 44 and a second face 46. Elastic ring 38 is normally flat but is pressed into the form shown in FIG. 1 by ring plate 36, which will be more fully discussed hereinafter. In the preferred embodiment, elastic ring 38 is formed from a polyurethane elastomer. A typical example of a suitable material is such a polyurethane which has the following properties:

| | |
|---|---|
| Tensile Strength: | |
| @ 50% elongation | 300 PSI |
| @ 100% elongation | 750 PSI |
| @ Break | 4400 PSI |
| Hardness (Type A) ASTM D2240 | 85 ± 5 |
| Elongation (at break) ASTM D412 | 550 Percent |

Ring plate 36 is generally annular in shape with one side having a frusto-conical ridge adjacent the inner diameter 48. The exterior of ring plate 36 is described by an outer diameter 50. Ring plate 36 has a generally planar first side 52 which faces cylinder member 14 and a second side 54 which faces closure member 20. A curved frustro-conical rib surface 56 forms a portion of the second side 54 which extends inwardly to support elastic ring 38. A chamfer 58 is located adjacent the junction of inner diameter 48 and first side 52 of ring plate 36. A small flattened surface 60 is formed at the junction of inner diameter 48 and curved portion 56 to prevent a sharp edge thereat.

Figure 2:
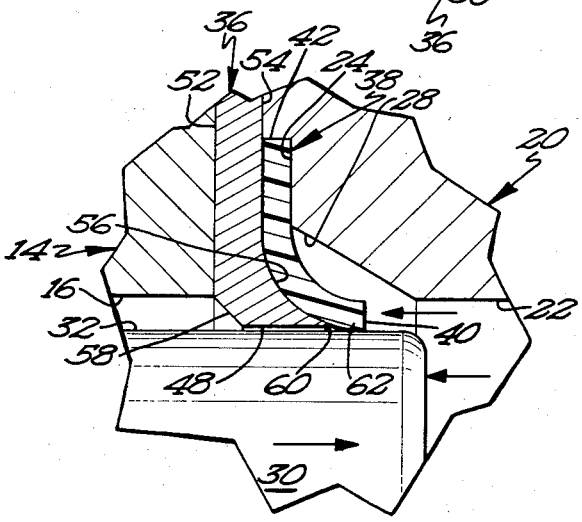
FIG. 2 is an enlarged fractional sectional detail showing the seal area during the pumping stroke of the piston.
Figure 3:
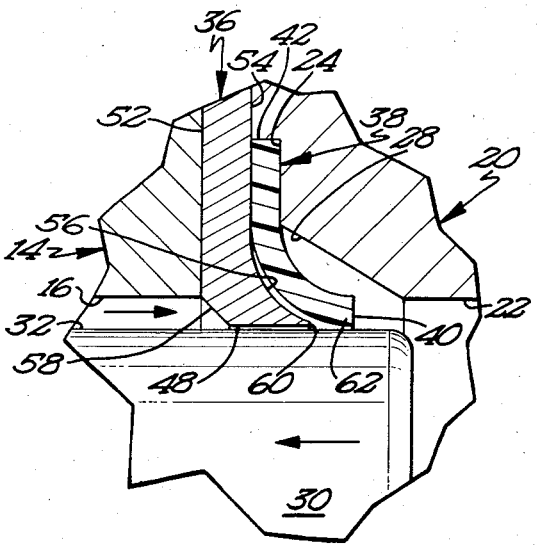
FIG. 3 is a view similar to FIG. 2 showing the return stroke of the piston.

The operation of the seal can be seen in FIGS. 2 and 3 with the arrows therein indicating the direction of piston movement and fluid pressure relative to the seal. Due to the relatively soft, flexible nature of the seal material, the ring plate 36 serves to form elastic ring 38 into the shape shown in the various drawing figures.

The use of the relatively soft seal material leads to substantially increased service life of the piston seal pair. While one might expect the particle embedding mechanism mentioned above in connection with hard seal materials to be worse with a soft seal material, such has not proven to be the case and, indeed, longer wearing life has resulted from such a construction.

It is contemplated that various changes and modifications may be made to the pump seal without departing from the spirit and scope of the invention as defined by the following claims.

What is claimed is:

1. A pump for fluent materials and especially suitable for moving heavy fluent and abrasive materials, comprising:

a housing member providing a hollow cylinder chamber receptive of material to be pumped and having an axially extending chamber wall and opposite ends;

a piston within and shorter than the cylinder chamber and having its perimeter of smaller diameter than and in limited spaced gap relation to said wall so that material can flow through the gap;

a closure at one end of the cylinder chamber and means for guiding a piston rod of the piston for axial forward and return strokes of the piston relative to the opposite end of the cylinder chamber;

a means for driving the piston rod and thereby the piston in said forward and return strokes;

a closure member and means securing the closure member to said housing member in closing relation to said opposite end of the cylinder chamber, and said closure member having a blind end chamber which forms a forward extension from the cylinder chamber and into which the piston extends a limited distance in the forward stroke of the piston, said blind end extension chamber being of a diameter which is larger than the diameter of the piston perimeter so that there is a limited spaced gap relation between the piston perimeter and said extension chamber when the piston extends into said extension chamber;

means for introducing into said cylinder chamber material to be pumped, and check valved means for receiving pumped material from said extension chamber;

a rigid annular ring plate clamped between said housing member and said closure member and having an inner annular rib portion which extends to an inner diameter smaller than the diameters of the cylinder chamber wall and the extension chamber wall but to a larger diameter than the piston perimeter diameter, said rib portion defining a port through which the piston moves freely when a forward end of the piston is entirely within the cylinder chamber and clear of said rib portion; and a combination valving, sealing and wiping elastic ring comprising a normally substantially flat elastic annular element fixedly clamped between said ring plate and said closure member and having an annular portion projecting radially inwardly beyond said rib portion to a substantially smaller diameter than the diameter of the piston perimeter, said elastic ring being engaged by the piston during the forward stroke through said rib portion and the piston elastically expanding the radially inwardly projecting portion of the elastic element into a tensioned sealing and wiping annular lip extending forwardly on the piston perimeter and maintaining pumping pressure in said blind end chamber against leakage past said rib flange during said forward stroke of the piston, the improvement comprising said ring plate having an outer diameter, first and second sides facing said housing and closure members, respectively, said first side being planar, said ring plate having a first thickness at said inner diameter and a second thickness less than said first thickness and said elastic ring being relatively soft such that said ring plate supports said elastic ring and urges said elastic ring into a generally frustroconical shape, wherein said elastic ring comprises an elastomer having an ASTM type-A hardness of approximately 80 to 90.

2. The pump of claim 1 wherein said ring plate second side facing said closure member is at least partially concave.

3. The pump of claim 1 wherein elastic ring comprises a polyurethane elastomer.

4. The pump of claim 1 wherein said elastic ring has a hardness of approximately 85.

5. The pump of claim 1 wherein said rib portion has an oblique annular lead-out surface on its cylinder chamber side to facilitate movement of material from the cylinder chamber past said rib portion into said extension chamber.

* * * * *